US009587460B2

(12) United States Patent
Clemens

(10) Patent No.: US 9,587,460 B2
(45) Date of Patent: Mar. 7, 2017

(54) SYSTEM AND METHOD FOR DEPLOYING A CASING PATCH

(71) Applicant: Halliburton Energy Services, Inc., Houston, TX (US)

(72) Inventor: Jack Gammill Clemens, Fairview, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 273 days.

(21) Appl. No.: 14/362,985

(22) PCT Filed: May 16, 2013

(86) PCT No.: PCT/US2013/041328
§ 371 (c)(1),
(2) Date: Jun. 5, 2014

(87) PCT Pub. No.: WO2014/185913
PCT Pub. Date: Nov. 20, 2014

(65) Prior Publication Data

US 2016/0138361 A1 May 19, 2016

(51) Int. Cl.
*E21B 33/12* (2006.01)
*E21B 33/128* (2006.01)
*E21B 43/10* (2006.01)
(Continued)

(52) U.S. Cl.
CPC ..... *E21B 33/128* (2013.01); *E21B 23/06* (2013.01); *E21B 29/10* (2013.01); *E21B 43/105* (2013.01)

(58) Field of Classification Search
CPC ..... E21B 33/128; E21B 33/129; E21B 33/13; E21B 33/134
See application file for complete search history.

(56) References Cited

U.S. PATENT DOCUMENTS 4,386,806 A * 6/1983 Axen ..... E21B 43/28 166/295
4,817,716 A * 4/1989 Taylor ..... E21B 17/02 166/207
(Continued)

FOREIGN PATENT DOCUMENTS

GB 2425801 A 11/2006
WO 2009100346 A1 8/2009

OTHER PUBLICATIONS

International Search Report and Written Opinion for PCT/US2013/41328 dated Feb. 11, 2014.

*Primary Examiner* — Matthew R Buck
*Assistant Examiner* — Aaron Lembo
(74) *Attorney, Agent, or Firm* — McDermott Will & Emery LLP; Scott Richardson

(57) ABSTRACT

Disclosed are systems and methods for deploying a casing patch in a wellbore. One casing patch assembly includes a setting kit arranged at an uphole end, an upper wedge portion operatively coupled to the setting kit and defining an upper ramp portion, a lower wedge portion arranged at a downhole end and defining a lower ramp portion, and a casing patch axially interposing the upper and lower wedge portions and having a proximal end configured to radially expand upon slidably engaging the upper ramp portion and a distal end configured to radially expand upon slidably engaging the lower ramp portion.

20 Claims, 4 Drawing Sheets

(51) Int. Cl.
*E21B 29/10* (2006.01)
*E21B 23/06* (2006.01)

(56) References Cited

U.S. PATENT DOCUMENTS 5,123,487 A * 6/1992 Harris ..... C09K 8/5045 166/277
5,195,584 A * 3/1993 Basinger, Jr. ..... E21B 33/124 166/185
6,029,748 A 2/2000 Forsyth et al.
6,142,230 A * 11/2000 Smalley ..... E21B 17/02 166/207
6,518,995 B1 * 2/2003 Ghole ..... E21B 29/10 348/143
6,612,372 B1 9/2003 Freiheit et al.
6,622,789 B1 9/2003 Braddick
6,775,894 B2 * 8/2004 Hardin ..... E21B 29/10 138/97
RE38,642 E * 11/2004 Gondouin ..... E21B 7/061 166/117.6
6,814,143 B2 11/2004 Braddick
6,997,260 B1 * 2/2006 Trader ..... E21B 29/10 138/99
7,401,647 B2 7/2008 Baycroft et al.
8,291,986 B2 * 10/2012 Gorrara ..... E21B 43/103 166/207
8,899,336 B2 * 12/2014 Giroux ..... E21B 23/01 166/210
2002/0092658 A1 * 7/2002 Johnson ..... E21B 33/128 166/384
2003/0019639 A1 * 1/2003 Mackay ..... E21B 17/14 166/384
2004/0074640 A1 * 4/2004 Anderton ..... E21B 29/10 166/277
2004/0159446 A1 * 8/2004 Haugen ..... E21B 43/103 166/384
2004/0194972 A1 10/2004 Braddick
2005/0241825 A1 * 11/2005 Burris ..... E21B 23/00 166/255.1
2006/0243452 A1 * 11/2006 Eckerlin ..... E21B 43/105 166/380
2009/0266560 A1 * 10/2009 Ring ..... E21B 43/105 166/384
2012/0097391 A1 4/2012 Whiddon
2012/0267099 A1 10/2012 Simson et al.
2013/0112412 A1 * 5/2013 Frazier ..... E21B 33/1204 166/298

* cited by examiner

SYSTEM AND METHOD FOR DEPLOYING A CASING PATCH

This application is a National Stage entry of and claims priority to International Application No. PCT/US2013/041328, filed on May 16, 2013.

BACKGROUND

The present disclosure is related to downhole tools and, more particularly, to a system and method for deploying a casing patch.

Wellbores drilled in the oil and gas industry are typically completed by cementing tubular casing strings within the newly formed borehole. The casing is commonly perforated or otherwise penetrated in order to evaluate and stimulate the surrounding subterranean formations. Besides these intentional perforations made in the casing, several unintentional holes or defects are also often created in the casing as a result of various wellbore intervention operations, remedial wellbore work and maintenance, or general weakness in the casing material. Such holes or defects can result in the development of unwanted leaks in the casing, which may lead to the loss of well fluids to a low pressure, porous zone outside the casing, or otherwise permit an unwanted formation fluid (e.g., water) to enter the well.

Regardless of the specific application, it is often necessary to deploy a patch or straddle to portions of the casing to seal the wellbore from the surrounding subterranean formation.

SUMMARY OF THE DISCLOSURE

The present disclosure is related to downhole tools and, more particularly, to a system and method for deploying casing patches.

In some embodiments, a casing patch assembly is disclosed and may include a setting kit arranged at an uphole end, an upper wedge portion operatively coupled to the setting kit and defining an upper ramp portion, a lower wedge portion arranged at a downhole end and defining a lower ramp portion, and a casing patch axially interposing the upper and lower wedge portions and having a proximal end configured to radially expand upon slidably engaging the upper ramp portion and a distal end configured to radially expand upon slidably engaging the lower ramp portion.

In other embodiments, a method of deploying a casing patch within a casing string is disclosed. The method may include conveying a casing patch assembly to a target location within the casing string, the casing patch assembly including a setting kit arranged at an uphole end, an upper wedge portion operatively coupled to the setting kit, a lower wedge portion arranged at a downhole end, and a casing patch axially interposing the upper and lower wedge portions, linearly actuating a power rod of a deployment device coupled to the setting kit, the power rod being operatively coupled to a mandrel such that movement of the power rod correspondingly moves the mandrel, moving the lower wedge portion with the mandrel, the mandrel being operatively coupled to the lower wedge portion via a locking device, radially expanding a distal end of the casing patch as the distal end slidingly traverses the lower wedge portion, and radially expanding a proximal end of the casing patch as the proximal end slidingly traverses the upper wedge portion.

The features of the present disclosure will be readily apparent to those skilled in the art upon a reading of the description of the embodiments that follows.

BRIEF DESCRIPTION OF THE DRAWINGS

The following figures are included to illustrate certain aspects of the present disclosure, and should not be viewed as exclusive embodiments. The subject matter disclosed is capable of considerable modifications, alterations, combinations, and equivalents in form and function, as will occur to those skilled in the art and having the benefit of this disclosure.

DETAILED DESCRIPTION

The present disclosure is related to downhole tools and, more particularly, to a system and method for deploying casing patches.

Disclosed are systems and methods of deploying a casing patch downhole for various wellbore operations or purposes. For instance, in some embodiments, the casing patch can be used to cover or seal a defect or damaged portion in a casing string or other wellbore tubular. In other embodiments, the casing patch may be used to locate and set a gas lift port for gas lift applications. In yet other embodiments, the casing patch may have a profile machined into its inner radial surface and serve as a locating profile set at a known location downhole and used for locking and/or locating various downhole tools. The casing patch forms part of a casing patch assembly that may be deployable using slickline or another type of known wellbore conveyance. The wellbore conveyance delivers the casing patch assembly to a target location at which point the casing patch may be deployed using a linear actuator or the like that axially compresses wedges configured to expand each end of the casing patch against the inner diameter of the casing string. Each expanded end creates a metal-to-metal seal and also an elastomeric seal between its outer diameter and the casing string.

Figure 1:
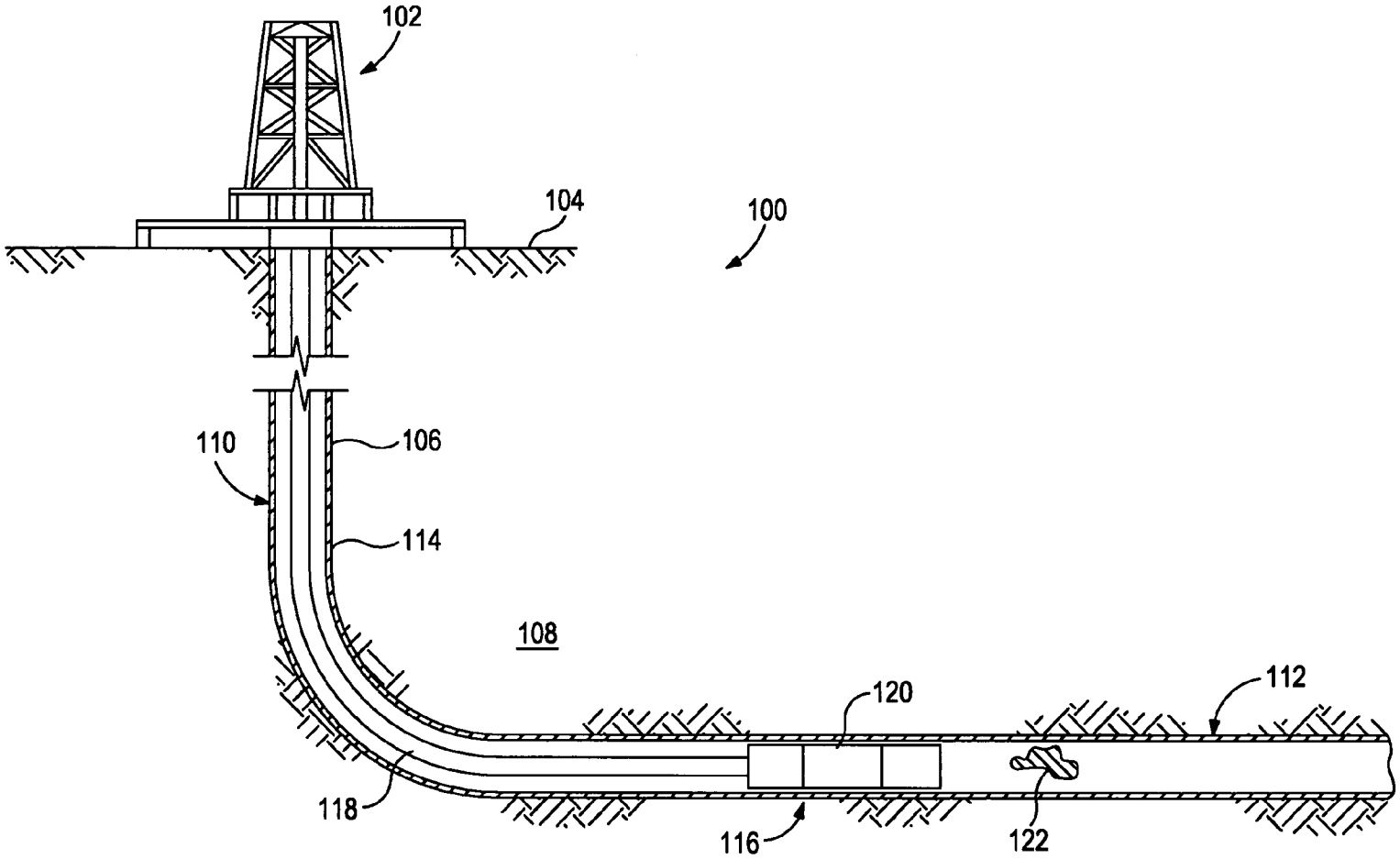
FIG. 1 illustrates an exemplary well system that may embody or otherwise employ one or more principles of the present disclosure, according to one or more embodiments.

Referring to FIG. 1, illustrated is a well system 100 that may embody or otherwise employ one or more principles of the present disclosure, according to one or more embodiments. As illustrated, the well system 100 may include a service rig 102 that is positioned on the earth's surface 104 and extends over and around a wellbore 106 that penetrates a subterranean formation 108. The service rig 102 may be a drilling rig, a completion rig, a workover rig, or the like. In some embodiments, the service rig 102 may be omitted and replaced with a standard surface wellhead completion or installation. Moreover, while the well system 100 is depicted as a land-based operation, it will be appreciated that the principles of the present disclosure could equally be applied in any sea-based or sub-sea application where the service rig 102 may be a floating platform or sub-surface wellhead installation, as generally known in the art.

The wellbore 106 may be drilled into the subterranean formation 108 using any suitable drilling technique and may extend in a substantially vertical direction away from the earth's surface 104 over a vertical wellbore portion 110. At some point in the wellbore 106, the vertical wellbore portion 110 may deviate from vertical relative to the earth's surface 104 and transition into a substantially horizontal wellbore portion 112. In some embodiments, the wellbore 106 may be completed by cementing a casing string 114 within the wellbore 106 along all or a portion thereof. As used herein, "casing string" may refer to any downhole tubular or string of tubulars known to those skilled in the art including, but not limited to, wellbore liner, production tubing, drill string, and other downhole piping systems.

The system 100 may further include a downhole tool 116 conveyed into the wellbore 106. The downhole tool 116 may be coupled or otherwise attached to a conveyance 118 that extends from the service rig 102. The conveyance 118 may be, but is not limited to, a wireline, a slickline, an electric line, coiled tubing, or the like. In some embodiments, the device 116 may be pumped downhole to a target location within the wellbore 106 using hydraulic pressure applied from the service rig 102 at the surface 104. In other embodiments, the device 116 may be conveyed to the target location using gravitational forces or otherwise.

As will be described in greater detail below, the downhole tool 116 may be configured to convey and deploy a casing patch 120 within the casing string 114. In some embodiments, the casing patch 120 may be configured to seal or otherwise repair a defect or perforation 122 in the casing string 114. In other embodiments, the casing patch 120 may have a locating profile (not shown) defined or otherwise machined into its inner diameter and the casing patch 120 may be deployed at a predetermined location within the wellbore 106 such that subsequent downhole tools or tool strings are able to interact therewith. In yet other embodiments, the casing patch 120 may define an orifice (not shown) configured to permit gas to pass therethrough such as is used to enhance the lift and production of well fluids to the surface 104. Those skilled in the art will readily appreciate the several other applications that the casing patch 120 may be used for, without departing from the scope of the disclosure.

Even though FIG. 1 depicts the downhole tool 116 as being arranged and operating in the horizontal portion 112 of the wellbore 106, the embodiments described herein are equally applicable for use in portions of the wellbore 106 that are vertical, deviated, or otherwise slanted. Moreover, use of directional terms such as above, below, upper, lower, upward, downward, uphole, downhole, and the like are used in relation to the illustrative embodiments as they are depicted in the figures, the upward direction being toward the top of the corresponding figure and the downward direction being toward the bottom of the corresponding figure, the uphole direction being toward the surface of the well and the downhole direction being toward the toe of the well. As used herein, the term "proximal" refers to that portion of the component being referred to that is closest to the wellhead, and the term "distal" refers to the portion of the component that is furthest from the wellhead.

Figure 2A:
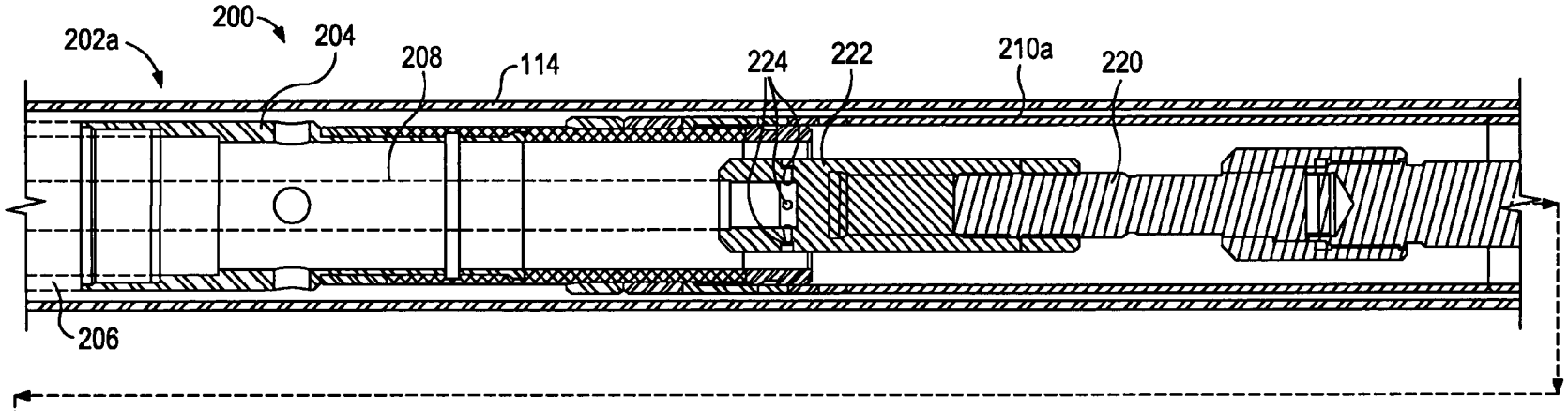
FIGS. 2A-2C illustrate contiguous cross-sectional views of an exemplary casing patch assembly, including an exemplary deployment device and setting kit, according to one or more embodiments.
Figure 2B:
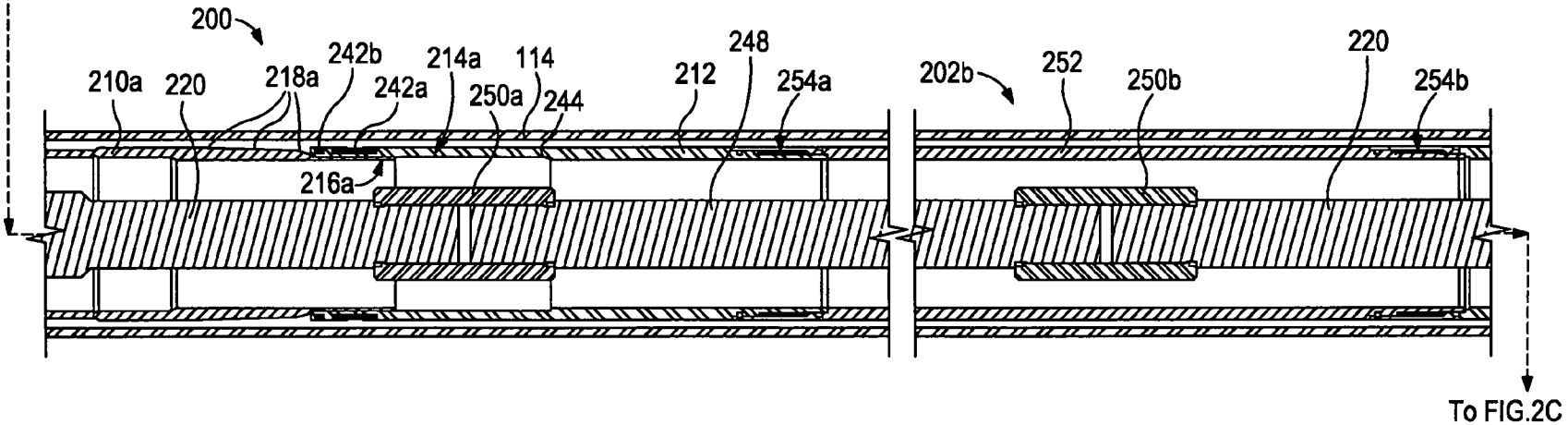
Figure 2C:
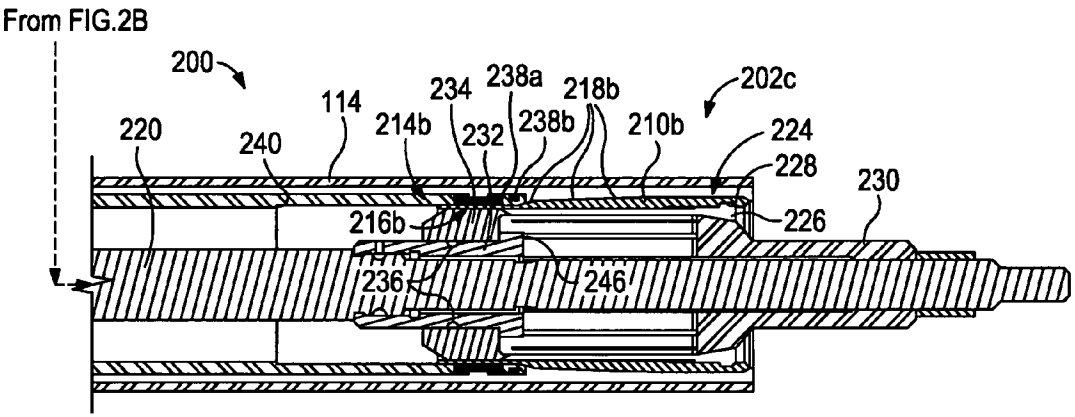

Referring now to FIGS. 2A-2C, with continued reference to FIG. 1, illustrated are contiguous cross-sectional views of an exemplary casing patch assembly 200, according to one or more embodiments. In particular, FIG. 2A depicts an uphole end 202*a* of the casing patch assembly 200, FIG. 2B depicts an intermediate portion 202*b* of the casing patch assembly 200, and FIG. 2C depicts a downhole end 202*c* of the casing patch assembly 200. The casing patch assembly 200 may be a generally tubular or cylindrical structure that may form part of or otherwise be attached to the downhole tool 116 of FIG. 1. As illustrated, the casing patch assembly 200 may be run into the wellbore 106 (FIG. 1) and otherwise arranged longitudinally within the casing string 114.

At its uphole end 202*a*, the casing patch assembly 200 may include an adapter or a setting kit 204 configured to couple or attach the casing patch assembly 200 to a deployment device 206 (shown in dashed). In some embodiments, the deployment device 206 may be threaded to the setting kit 204 at the uphole end 202*a* of the casing patch assembly 200. In other embodiments, the deployment device 206 may be mechanically fastened to the setting kit 204 using one or more types of mechanical fasteners, such as bolts, screws, setscrews, shearable devices, or the like.

In some embodiments, the deployment device 206 may be a linear actuator, such as the DPU® tool available through Halliburton Energy Services, Inc. of Houston, Tex., USA. In other embodiments, the deployment device 206 may be any other downhole device configured to provide a linear force and otherwise facilitate the proper deployment of the casing patch assembly 200, as described in greater detail below. For instance, the deployment device 206 may include, but is not limited to, a mechanical actuator, a hydraulic actuator, a pneumatic actuator, a piezoelectric actuator, an electromechanical actuator, combinations thereof, and the like. The deployment device 206 may have or otherwise include a power rod 208 configured to be linearly actuated. In exemplary operation, the deployment device 206 may be configured to axially extend or retract the power rod 208, depending on the application and the desired result.

The casing patch assembly 200 may further include an upper wedge portion 210*a* (FIGS. 2A and 2B), a lower wedge portion 210*b* (FIG. 2C), and a casing patch 212 that axially interposes the upper and lower wedge portions 210*a,b*. The upper wedge portion 210*a* may be either operatively coupled to the setting kit 204 or may otherwise form an integral part thereof. The lower wedge portion 210*b* may be generally arranged at the downhole end 202*c* of the casing patch assembly 200. The casing patch 212 may be slidably engaged with both the upper wedge and lower wedge portions 210*a,b*. In particular, the casing patch 212 may have a proximal end 214*a* (FIG. 2B) that is slidably engaged with a distal end 216*a* of the upper wedge portion 210*a* and a distal end 214*b* (FIG. 2C) that is slidably engaged with a proximal end 216*b* of the lower wedge portion 210*b*.

The distal end 216*a* of the upper wedge portion 210*a* may define or otherwise provide an inclined surface or one or more upper ramp portions 218*a* (FIG. 2B). Similarly, the proximal end 216*b* of the lower wedge portion 210*b* may define or otherwise provide an inclined surface or one or more lower ramp portions 218*b* (FIG. 2C). As will be described in greater detail below, the upper and lower ramp portions 218*a,b* may be configured to slidably engage and thereby radially expand the proximal and distal ends 214*a,b*, respectively, of the casing patch 212. The proximal and distal ends 214*a,b* may be radially expanded until coming into sealing engagement with the inner wall of the casing string 114, thereby forming a seal at each end of the casing patch 212.

The casing patch assembly 200 may further include a mandrel 220 that extends longitudinally within at least a portion of the upper and lower wedge portions 210*a,b* and the casing patch 212. The mandrel 220 may be operatively coupled to the power rod 208 (FIG. 2A) such that axial movement of the power rod 208 (as actuated by the deployment device 206) moves the mandrel 220 in a corresponding axial direction. In some embodiments, the mandrel 220 may be coupled to the power rod 208 via a coupling 222. The coupling 222 may be configured such that one or both of the mandrel 220 and the power rod 208 are threadably coupled thereto at each end. In at least one embodiment, however, the power rod 208 may be coupled to the coupling 222 using one or more mechanical fasteners 224, such as setscrews, bolts, or the like. In other embodiments, however, the coupling 222 may be omitted and the mandrel 220 may instead be directly coupled to the power rod 208 either by threaded engagement or mechanical fasteners.

In some embodiments, the casing patch assembly 200 may also include a locking device 224 (FIG. 2C) arranged at the downhole end 202*c*. The locking device 224 may be coupled or attached to the mandrel 220 and configured to operatively couple the mandrel 220 to the lower wedge portion 210*b* such that movement of the mandrel 220 correspondingly moves the lower wedge portion 210*b* in the same axial direction. In operation, the locking device 224 may be configured to maintain the lower wedge portion 210*b* operatively coupled to the mandrel 220 until a predetermined axial load provided by the mandrel 220 is experienced or otherwise assumed across the locking device 224. Once the predetermined axial load is assumed by the locking device 224, the locking device 224 may be configured to yield, thereby effectively separating the mandrel 220 from the lower wedge portion 210*b* and otherwise allowing the mandrel 220 to axially translate unobstructed by the lower wedge portion 210*b*.

In at least one embodiment, the locking device 224 may be a shearable device, such as a shear pin, a shear ring, or another type of shearable mechanism configured to couple the locking device 224 to the lower wedge portion 210*b* and yield upon experiencing the predetermined axial load. In other embodiments, however, as illustrated in FIG. 2C, the locking device 224 may encompass a collet assembly. The collet assembly may include a plurality of axially extending fingers 226 configured to be seated within a groove 228 defined or otherwise provided in the inner radial surface of the lower wedge portion 210*b*. A bridge support 230 may be coupled or attached to the mandrel 220 and may be configured or arranged to bias the fingers 226 into the groove 228 such that the fingers 226 become immovably engaged within the groove 228.

The collet assembly may further include a shear sub 232 that may be coupled or otherwise attached to the mandrel 220 uphole from the bridge support 230. A spacer ring 234 may interpose or otherwise be arranged radially between the shear sub 232 and an inner surface of the lower wedge portion 210*b*. In at least one embodiment, the shear sub 232 may define or provide a shear point 236. The shear point 236 may be an annular groove or thinned portion of the shear sub 232 that may be configured to fail, separate, or break upon assuming the predetermined axial load as delivered through the mandrel 220. In other embodiments, the shear point 236 may instead be a shear pin, a shear ring, or any other shearable device or mechanism coupling the shear sub 232 to the spacer ring 234 and otherwise configured to fail upon assuming the predetermined axial load.

Figure 3:
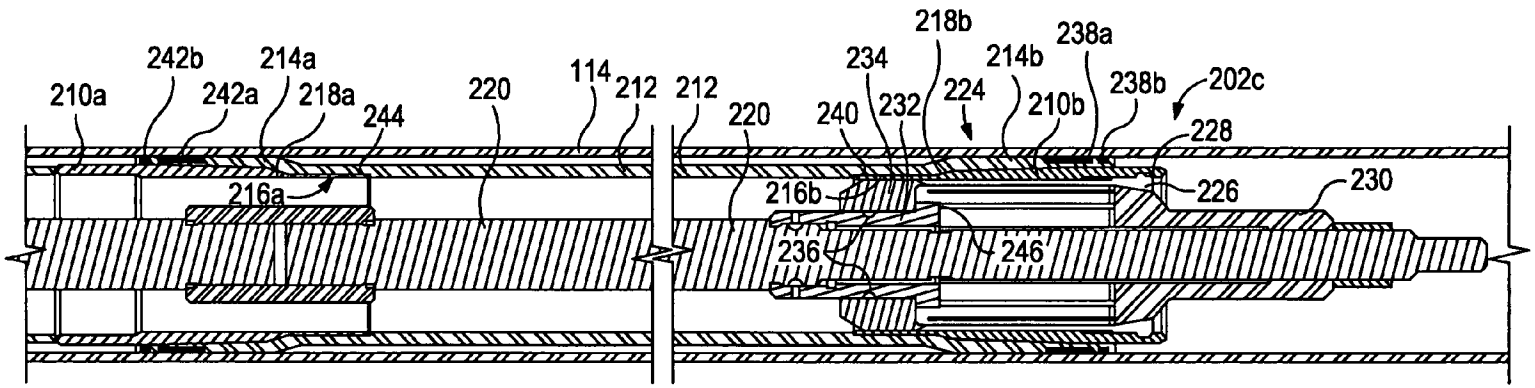
FIG. 3 illustrates depicts portions of the casing patch assembly in a deployed configuration, according to one or more embodiments of the disclosure.

Exemplary operation of the casing patch assembly 200 will now be provided, in conjunction with additional reference to FIG. 3. FIGS. 2A-2C depict the casing patch assembly 200 in an un-deployed configuration and FIG. 3 depicts portions of the casing patch assembly 200 in a deployed configuration. When it is desired to deploy the casing patch 212 downhole, the casing patch assembly 200 is conveyed to a target location within the casing string 114. In some embodiments, the target location may be a location within the casing string 114 in need of the casing patch 212 to seal a particular portion of the casing string 114, such as where the defect or perforation 122 of FIG. 1 is apparent. In other embodiments, the target location may be a location where it is desirable to place a gas lift port (not shown) as defined in the casing patch 212, such as is used to enhance the lift and production of well fluids to the surface 104 (FIG. 1). In yet other embodiments, the target location may be a location within the casing string 114 where it is desirable to install a locating profile (not shown) defined or otherwise machined into the inner diameter and the casing patch 212.

Upon reaching the target location, the deployment device 206 may be actuated, thereby linearly actuating the power rod 208. In particular, the deployment device 206 may be actuated such that the power rod 208 is retracted proximally, or in the uphole direction (i.e., to the left in FIG. 2A). As the power rod 208 is retracted, the mandrel 220 is correspondingly moved in the same axial direction as coupled to the power rod 208. With reference to FIG. 2C, moving the mandrel 220 in the uphole direction (i.e., to the left in FIG. 2C) may force the lower wedge portion 210*b* in the same direction as coupled to the mandrel 220 via the locking device 224. In embodiments where the locking device 224 is a collet assembly, such as the one depicted in FIG. 2C, the mandrel 220 may be operatively coupled to the lower wedge portion 210*b* via the fingers 226 seated within the groove 228 of the lower wedge portion 210*b* and secured therein against removal with the bridge support 230.

As the mandrel 220 moves in the uphole direction, the lower wedge portion 210*b* correspondingly moves in the same direction and its proximal end 216*b* slides underneath the distal end 214*b* of the casing patch 212. Continued movement of the mandrel 220 and the lower wedge portion 210*b* in the uphole direction may force the distal end 214*b* of the casing patch 212 to expand as it traverses or slides up the lower ramp portions 218*b*. In some embodiments, the casing patch 212 may be made of a material that is less robust than the lower wedge portion 210*b* such that the casing patch 212 is able to radially expand upon slidably interacting with the lower wedge portion 210*b*. In some embodiments, for example, the casing patch 212 may be made of a mild or low-carbon steel, such as carbon steel 1018, and the lower wedge portion 210*b* may be made of a more robust material, such as hardened steel.

In some embodiments, a lubricant (not shown) may be employed between or otherwise interpose the distal end 214*b* of the casing patch 212 and the proximal end 216*b* of the lower wedge portion 210*b*, including the lower ramp portions 218*b*. Such a lubricious interface may facilitate a smoother sliding engagement between the distal end 214*b* of the casing patch 212 and the lower wedge portion 210*b*. In some embodiments, a graphite or TEFLON® substrate or a nitride hard surface may be applied to one or both of the distal end 214*b* of the casing patch 212 and the lower ramp portions 218*b* or otherwise generally interpose the two components. In other embodiments, one or both of the distal end 214*b* of the casing patch 212 and the lower ramp portions 218*b* may be impregnated with a lubricious compound or material, such as oil or graphite, in order that a generally lubricated interface results.

Referring to FIG. 3, with continued reference to FIG. 2C, the distal end 214*b* of the casing patch 212 expands as it axially traverses the lower ramp portions 218*b* until engaging the inner wall of the casing string 114 and thereby generating a metal-to-metal seal between the casing patch 212 and the casing string 114. In some embodiments, the distal end 214*b* may further include or otherwise provide one or more sealing elements 238 (shown as first and second sealing elements 238*a* and 238*b*, respectively) configured to provide a sealed interface between the distal end 214*b* of the casing patch 212 and the casing string 114. The first sealing element 238*a* may be an elastomeric or rubber seal arranged within a groove defined in the distal end 214*b* of the casing patch 212. In some embodiments, the first sealing element 238*a* may be non-swellable, but in other embodiments, the first sealing element 238*a* may be swellable upon interacting with a particular wellbore fluid, treatment fluid, temperature gradient, wellbore pressure, or the like. The second sealing element 238*b* may be an elastomeric O-ring or the like. Accordingly, the first and second seals 238*a,b* may provide redundant sealing capabilities at the interface between the distal end 214*b* of the casing patch 212 and the casing string 114.

The mandrel 220 and the lower wedge portion 210*b* may continue to move in the uphole direction until the lower wedge portion 210*b* engages a radial shoulder 240 defined on the inner surface of the distal end 214*b* of the casing patch 212. Upon engaging the radial shoulder 240, the axial force assumed by the lower wedge portion 210*b* may be transferred to the casing patch 212, thereby serving to also move the casing patch 212 in the same axial direction. With reference to FIG. 2B, and continued reference to FIG. 3, as the mandrel 220 continues to move in the uphole direction (i.e., to the left in FIG. 2B), the casing patch 212 correspondingly moves in the same direction and its proximal end 214*b* slidably engages the distal end 216*a* of the upper wedge portion 210*a*. In particular, the distal end 216*a* of the upper wedge portion 210*a* may be configured to slide underneath the proximal end 214*a* of the casing patch 212.

Continued movement of the mandrel 220 and the casing patch 212 in the uphole direction may radially expand the proximal end 214*a* of the casing patch 212 as it traverses or slides up the upper ramp portions 218*a*. As mentioned above, the casing patch 212 may be made of a soft material, such as mild steel or the like, such that its proximal end 214*a* is also able to radially expand upon interacting with the upper wedge portion 210*a* which, similar to the lower wedge portion 210*b*, may be made of a more robust material. Moreover, a lubricant (similar to that mentioned above) may be employed between or otherwise interpose the proximal end 214*a* of the casing patch 212 and the distal end 216*a* of the upper wedge portion 210*a*, including the upper ramp portions 218*a*, such that a smoother sliding engagement is facilitated between the two components.

Accordingly, the proximal end 214*a* of the casing patch 212 may be configured to radially expand as it traverses the upper ramp portions 218*a* in the uphole direction. As the proximal end 214*a* expands, it eventually engages the inner wall of the casing string 114, thereby generating a metal-to-metal seal between the casing patch 212 and the casing string 114 at that location. Similar to the distal end 214*b* of the casing patch 212, the proximal end 214*a* may also include or otherwise provide one or more sealing elements 242 (shown as first and second sealing elements 242*a* and 242*b*, respectively) configured to provide a sealed interface between the proximal end 214*a* of the casing patch 212 and the casing string 114. The first and second sealing elements 242*a,b* may be similar to the first and second sealing elements 238*a,b* described above, and therefore will not be described again. Accordingly, the first and second sealing elements 242*a,b* may provide redundant sealing capabilities at the interface between the proximal end 214*a* of the casing patch 212 and the casing string 114.

The proximal end 214*a* of the casing patch 212, as forced by the lower wedge portion 210*b* and the mandrel 220, may continue to move in the uphole direction until the upper wedge portion 210*a* engages a radial shoulder 244 defined on the inner surface of the proximal end 214*a*. Upon engaging the radial shoulder 244, movement of the mandrel 220 in the uphole direction is effectively prevented with the lower wedge portion 210*b* engaged with the radial shoulder 240 at the distal end 214*b* of the casing patch 212, and the upper wedge portion 210*a* engaged with the radial shoulder 244 at the proximal end 214*a* of the casing patch 212.

At this point, the power rod 208 may be configured to increase its axial load on the mandrel 220 in order to separate the mandrel 220 from operative engagement with the casing patch 212. In particular, the power rod 208 may be configured to increase its axial load on the mandrel 220 in the uphole direction until reaching a predetermined axial load of the locking device 224. As described above, once the predetermined axial load is assumed by the locking device 224, the locking device 224 may be configured to yield, thereby allowing the mandrel 220 to separate from the lower wedge portion 210*b* such that the casing patch assembly 200, minus the casing patch 212, may be retrieved to the surface 104 (FIG. 1).

In embodiments where the locking device 224 is a collet assembly, as illustrated in FIGS. 2C and 3, the shear point 236 on the shear sub 232 may be configured to fail, separate, or break upon assuming the predetermined axial load delivered through the mandrel 220. In particular, the shear sub 232 may further define a radial protrusion 246 configured to axially engage the spacer ring 234. As the predetermined axial load is reached or surpassed, the engagement between the radial protrusion 246 and the spacer ring 234 forces the shear sub 232 to fail at the shear point 236. Once the shear sub 232 fails, the bridge support 230 may then be able to move axially in the uphole direction and otherwise out of biasing engagement with the plurality of axially extending fingers 226. Without the bridge support 230 forcing the fingers 226 into the groove 228 defined in the inner radial surface of the lower wedge portion 210*b*, the fingers 226 may then be able to flex inward and out of engagement with the groove 228. As a result, the collet assembly (i.e., the locking device 224) may be disengaged from the lower wedge portion 210*b* and free to ascend in the uphole direction while the lower wedge portion 210*b* is left downhole with the casing patch 212.

Figure 4A:
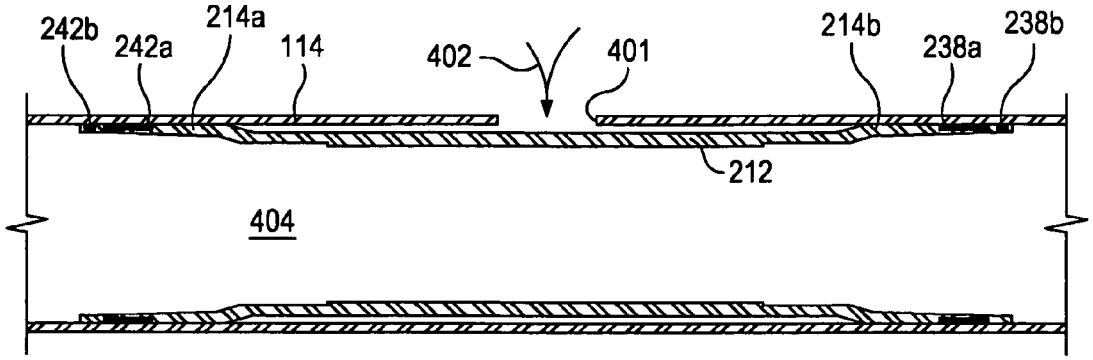
FIGS. 4A-4C illustrate cross-sectional views of a casing patch deployed within a casing string for various purposes, according to one or more embodiments of the disclosure.
Figure 4B:
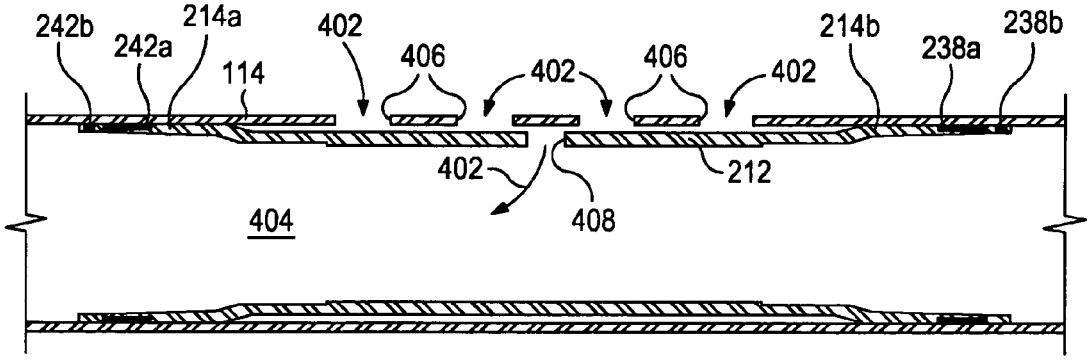
Figure 4C:
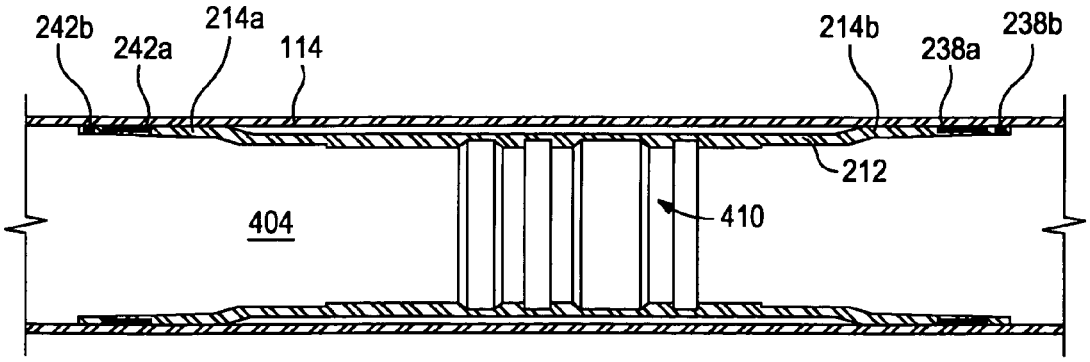

Referring now to FIGS. 4A-4C, with continued reference to the prior figures, illustrated are cross-sectional views of the casing patch 212 as installed or otherwise deployed within the casing string 114, according to one or more embodiments of the disclosure. While FIGS. 4A-4C illustrate at least three exemplary applications of the casing patch 212, those skilled in the art will readily appreciate that the casing patch 212 may be employed in several other downhole applications, without departing from the scope of the disclosure. Moreover, it should be noted that the length and sizing of the casing patch 212 is not necessarily drawn to scale in FIGS. 4A-4C, and therefore should not be considered as limiting the present disclosure. Rather, those skilled in the art will readily recognize that FIGS. 4A-4C merely depict exemplary applications of the casing patch 212, as consistent with the principles of the disclosure.

In FIG. 4A, the casing string 114 has a defect or hole 401 (e.g., similar to the defect 122 of FIG. 1) formed or defined therein. Unless the defect 401 is properly sealed, unwanted wellbore fluids 402, such as water, may enter into the interior 404 of the casing string 114 and be produced to the surface 104 (FIG. 1). In order to prevent the unwanted fluids 402 from being produced to the surface 104 via the defect 401, the casing patch 212 may be deployed within the casing string 114, as generally described above. In particular, the casing patch 212 may be deployed such that it straddles the defect 401 and is sealed at each end using the metal-to-metal seal between the proximal and distal ends 214*a,b* and the inner wall of the casing string 114 and the sealing elements 238*a,b* and 242*a,b*. Once properly deployed and sealed, the casing patch 212 may prevent the fluids 402 from entering the interior 404 of the casing string 114.

In FIG. 4B, one or more perforations 406 may have been formed or otherwise defined in the casing string 114. The perforations 406 may have been formed, for example, through casing perforation operations or a punch tool in order to extract the fluids 402 from the surrounding formations in a predetermined fashion. As illustrated, the casing patch 212 may be deployed in the casing string 114 to generally straddle the perforations 406. The casing patch 212 may have an orifice 408 defined therein configured to permit the fluid 402 to pass therethrough at a predetermined flow rate. In some embodiments, the orifice 408 may have an inflow control device or other flow restrictor arranged therein that is configured to regulate fluid flow into the interior 404 of the casing string 114. In other embodiments, the fluid 402 may be a gas, either originating from the surrounding formation or injected from the surface 104 (FIG. 1), and the orifice 408 may be used as a gas lift port adapted to enhance the lift and production of well fluids within the interior 404 of the casing string 114 to the surface 104. In such embodiments, the orifice 408 may be a metered gas lift port and may be hardened so that it is resistant to washout.

In FIG. 4C, the casing patch 212 may include a locating profile 410 defined or otherwise machined into its inner diameter. As known to those skilled in the art, locating profiles 410 may be used such that downhole tools exhibiting a corresponding or matching profile are able to mate therewith. In some embodiments, the casing patch 212 may be deployed at a predetermined location within the casing string 114 such that the locating profile 410 is arranged at a known location for subsequent downhole tools or tool strings to interact therewith. In other embodiments, the locating profile 410 may be used to replace a damaged profile or locate a new locating profile at a more desirable location within the casing string 114.

Referring again to FIG. 2B, in some embodiments, the mandrel 220 may be an undivided cylindrical rod that extends from the power rod 208 (or coupling 222 of FIG. 2A) to the locking device 224 in a single, integral piece. In other embodiments, however, the mandrel 220 may include one or more mandrel extensions 248 (one shown) that may interpose proximal and distal portions of the mandrel 220. In the embodiment of FIG. 2B, the mandrel extension 228 may be coupled or otherwise attached to the mandrel 220 at each end using couplings 250*a* and 250*b*. The couplings 250*a,b* may provide a threaded or mechanically fastened engagement between the mandrel extension 228 and the mandrel 220 at each end, or a combination thereof. Accordingly, in at least one embodiment, the axial length of the mandrel 220 may be extended by employing one or more mandrel extensions 248.

Similarly, in some embodiments, the casing patch 212 may be an undivided cylindrical tubular that extends from its proximal end 214*a* to its distal end 214*b* in a single, integral piece. In other embodiments, however, the casing patch 212 may include one or more patch extenders 252 (one shown) that may interpose the proximal and distal ends 214*a,b* of the casing patch 212. As illustrated in FIG. 2B, the patch extender 252 may be coupled to or otherwise attached to the proximal and distal ends 214*a,b* using coupling interfaces 254*a* and 254*b*. In particular, the patch extender 252 may be coupled to the proximal end 214*a* of the casing patch 212 at the first coupling interface 254*a* and coupled to the distal end 214*b* of the casing patch 212 at the second coupling interface 254*b*. The coupling interfaces 254*a,b* may be threaded engagements, mechanically fastened engagements, or a combination of the two. In one or more embodiments, at least one of the coupling interfaces 254*a,b* may be welded or brazed in order to couple the patch extender 252 to the proximal and/or distal ends 214*a,b*. As a result, the axial length of the casing patch 212 may be extended by employing one or more patch extenders 252.

Therefore, the disclosed systems and methods are well adapted to attain the ends and advantages mentioned as well as those that are inherent therein. The particular embodiments disclosed above are illustrative only, as the teachings of the present disclosure may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative embodiments disclosed above may be altered, combined, or modified and all such variations are considered within the scope and spirit of the present disclosure. The systems and methods illustratively disclosed herein may suitably be practiced in the absence of any element that is not specifically disclosed herein and/or any optional element disclosed herein. While compositions and methods are described in terms of "comprising," "containing," or "including" various components or steps, the compositions and methods can also "consist essentially of" or "consist of" the various components and steps. All numbers and ranges disclosed above may vary by some amount. Whenever a numerical range with a lower limit and an upper limit is disclosed, any number and any included range falling within the range is specifically disclosed. In particular, every range of values (of the form, "from about a to about b," or, equivalently, "from approximately a to b," or, equivalently, "from approximately a-b") disclosed herein is to be understood to set forth every number and range encompassed within the broader range of values. Also, the terms in the claims have their plain, ordinary meaning unless otherwise explicitly and clearly defined by the patentee. Moreover, the indefinite articles "a" or "an," as used in the claims, are defined herein to mean one or more than one of the element that it introduces. If there is any conflict in the usages of a word or term in this specification and one or more patent or other documents that may be incorporated herein by reference, the definitions that are consistent with this specification should be adopted.

The invention claimed is:

1. A casing patch assembly, comprising:

a setting kit arranged at an uphole end and having a linearly actuatable power rod operatively coupled to a mandrel such that movement of the power rod correspondingly moves the mandrel;

an upper wedge portion operatively coupled to the setting kit;

a lower wedge portion operatively coupled to the mandrel at a downhole end; and a casing patch extending between the upper and lower wedge portions and having a proximal end engaging the upper wedge portion and a distal end engaging the lower wedge portion, wherein actuation of the setting kit causes the upper wedge portion to radially expand the proximal end of the casing patch and causes the lower wedge portion to radially expand the distal end of the casing patch.

2. The casing patch assembly of claim 1, further comprising:

a mandrel operatively coupled to the power rod such that linear movement of the power rod correspondingly moves the mandrel; and a locking device releasably coupled to the mandrel at the downhole end and configured to operatively couple the mandrel to the lower wedge portion such that movement of the mandrel correspondingly moves the lower wedge portion, wherein the locking device maintains the lower wedge portion operatively coupled to the mandrel until a predetermined axial load provided by the power rod is assumed across the locking device.

3. The casing patch assembly of claim 2, wherein the locking device is a collet assembly comprising:

a plurality of axially extending fingers configured to be seated within a groove defined in an inner radial surface of the lower wedge portion;

a bridge support coupled to the mandrel and configured to bias the plurality of fingers into the groove;

a shear sub coupled to the mandrel uphole from the bridge support and having a shear point defined therein; and a spacer ring arranged radially between the shear sub and the inner radial surface of the lower wedge portion, wherein the shear point is configured to fail upon assuming the predetermined axial load.

4. The casing patch assembly of claim 2, wherein the mandrel includes one or more mandrel extensions arranged between opposing ends of the mandrel and thereby increasing an axial length of the mandrel.

5. The casing patch assembly of claim 1, wherein the casing patch includes one or more patch extenders interposing the proximal and distal ends of the casing patch, the one or more patch extenders being configured to increase an axial length of the casing patch.

6. The casing patch assembly of claim 1, wherein the casing patch is made of a material that is less robust than the upper and lower wedge portions and therefore able to axially expand upon slidably engaging the upper and lower wedge portions.

7. The casing patch assembly of claim 1, further comprising a lubricant employed between at least one of the proximal and distal ends of the casing patch and the upper and lower wedge portions, respectively.

8. The casing patch assembly of claim 7, wherein the lubricant is a lubricious substrate applied to at least one of the proximal and distal ends of the casing patch and the upper and lower wedge portions.

9. The casing patch assembly of claim 1, wherein the casing patch is used to seal a defect formed in a casing string.

10. The casing patch assembly of claim 1, wherein casing patch defines an orifice therein configured to permit a fluid to pass therethrough at a predetermined flow rate.

11. The casing patch assembly of claim 1, wherein a locating profile is defined on an inner diameter of the casing patch.

12. The casing patch assembly of claim 1, further comprising one or more sealing elements provided on at least one of the proximal and distal ends of the casing patch, the one or more sealing elements being configured to provide a sealed interface between the casing patch and an inner surface of a casing string.

13. The casing patch assembly of claim 12, wherein at least one of the one or more sealing elements is a swellable sealing element.

14. A method of deploying a casing patch within a casing string, comprising:

conveying a casing patch assembly to a target location within the casing string, the casing patch assembly including:

a setting kit arranged at an uphole end of the casing patch assembly and having a linearly actuatable power rod operatively coupled to a mandrel such that movement of the power rod correspondingly moves the mandrel;

an upper wedge portion operatively coupled to the setting kit;

a lower wedge portion operatively coupled to a downhole end of the mandrel; and a casing patch extending between the upper and lower wedge portions and having a proximal end engaging the upper wedge portion and a distal end engaging the lower wedge portion;

linearly actuating the power rod and thereby moving the lower wedge portion with the mandrel;

radially expanding the distal end of the casing patch with the lower wedge portion as the lower wedge portion slidingly engages the distal end; and radially expanding the proximal end of the casing patch with the upper wedge portion as the upper wedge portion slidingly engages the proximal end.

15. The method of claim 14, wherein linearly actuating the power rod comprises retracting the power rod in an uphole direction and thereby retracting the mandrel and the lower wedge portion in the uphole direction.

16. The method of claim 14, wherein radially expanding the distal end of the casing patch comprises:

slidably engaging the distal end of the casing patch with one or more lower ramp portions defined on the lower wedge portion; and forcing the distal end of the casing patch into sealing engagement with an inner wall of the casing string.

17. The method of claim 14, wherein radially expanding the proximal end of the casing patch comprises:

slidably engaging the proximal end of the casing patch with one or more upper ramp portions defined on the upper wedge portion; and forcing the proximal end of the casing patch into sealing engagement with an inner wall of the casing string.

18. The method of claim 14, wherein the mandrel is operatively coupled to the lower wedge portion via a locking device, the method further comprising:

providing a predetermined axial load to the locking device with the power rod as coupled to the mandrel; and allowing the locking device to yield upon assuming the predetermined axial load and thereby separating the mandrel from the lower wedge portion.

19. The method of claim 14, wherein the locking device is a collet assembly and moving the lower wedge portion with the mandrel comprises:

locating a plurality of axially extending fingers into a groove defined in an inner radial surface of the lower wedge portion; and biasing and maintaining the plurality of axially extending fingers within the groove with a bridge support coupled to the mandrel.

20. The method of claim 19, further comprising:

providing a predetermined axial load to the collet assembly with the power rod as coupled to the mandrel;

breaking a shear sub at a shear point upon the shear sub assuming the predetermined axial load, the shear sub being coupled to the mandrel uphole from the bridge support; and moving the bridge support out of biasing engagement with the plurality of axially extending fingers and thereby allowing the plurality of axially extending fingers to flex out of engagement with the groove so that the collet assembly is disengaged from the lower wedge portion.

* * * * *